US006173702B1

(12) United States Patent
Hoeg

(10) Patent No.: US 6,173,702 B1
(45) Date of Patent: Jan. 16, 2001

(54) MOVABLE WALL MEMBER IN THE FORM OF AN EXHAUST VALVE SPINDLE OR A PISTON IN AN INTERNAL COMBUSTION ENGINE

(75) Inventor: Harro Andreas Hoeg, Allerød (DK)

(73) Assignee: Man B&W Diesel A/S, Copen Hagen Sv (DK)

( * ) Notice: Under 35 U.S.C. 154(b), the term of this patent shall be extended for 0 days.

(21) Appl. No.: 09/180,820

(22) PCT Filed: May 13, 1997

(86) PCT No.: PCT/DK97/00219

§ 371 Date: Nov. 12, 1998

§ 102(e) Date: Nov. 12, 1998

(87) PCT Pub. No.: WO97/43525

PCT Pub. Date: Nov. 20, 1997

(30) Foreign Application Priority Data

May 15, 1996 (DK) ..... 0580/96

(51) Int. Cl.[7] ..... F02B 23/00
(52) U.S. Cl. ..... 123/668
(58) Field of Search ..... 123/188.3, 668

(56) References Cited

U.S. PATENT DOCUMENTS

| | | | | |
|---|---|---|---|---|
| 4,817,578 | * | 4/1989 | Ushio et al. | 123/668 |
| 4,864,987 | * | 9/1989 | Kawamura | 123/193.4 |
| 5,071,054 | | 12/1991 | Dzugan et al. . | |
| 5,722,379 | * | 3/1998 | Binder et al. | 123/668 |
| 5,958,332 | * | 9/1999 | Hoeg | 420/442 |

FOREIGN PATENT DOCUMENTS

| | | | |
|---|---|---|---|
| 32 07 276 A1 | | 10/1982 | (DE) . |
| 0 246 092 | | 11/1987 | (EP) . |
| 0 521 821 A2 | | 1/1993 | (EP) . |
| 0 543 353 A1 | | 5/1993 | (EP) . |
| 0728917 | * | 1/1996 | (EP) . |
| 0 728 917 A1 | | 8/1996 | (EP) . |
| 1 571 330 | | 7/1980 | (GB) . |
| 2 202 235 | | 9/1988 | (GB) . |
| WO 96/18747 | | 6/1996 | (WO) . |

* cited by examiner

*Primary Examiner*—Willis R. Wolfe
*Assistant Examiner*—Jason Benton
(74) *Attorney, Agent, or Firm*—Sughrue, Mion, Zinn, Macpeak & Seas, PLLC

(57) ABSTRACT

A wall member is on its side facing a combustion chamber provided with a hot-corrosion-resistant material made from a particulate starting material of an alloy containing nickel and chromium which by a HIP process has been unified to a coherent material substantially without melting the starting material. In terms of percent by weight the corrosion-resistant material comprises from 38 to 75% Cr, at the most 0.15% C, at the most 1.5% Si, at the most 1.0% Mn, at the most 0.2% B, at the most 5.0% Fe, at the most 1.0% Mg, at the most 2.5% Al, at the most 2.0% Ti, at the most 8.0% Co, at the most 3.0% Nb and a balance of Ni, the aggregate contents of Al and Ti amounting at the most to 4.0%, and the aggregate contents of Fe and Co amounting at the most to 8.0%, and the aggregate contents of Ni and Co amounting at the least to 25%. The corrosion-resistant material has a hardness of less than 310 HV measured at approximately 20° C. after the material has been heated to a temperature within the range of 550–850° C. for more than 400 hours.

34 Claims, 1 Drawing Sheet

Figure 1:
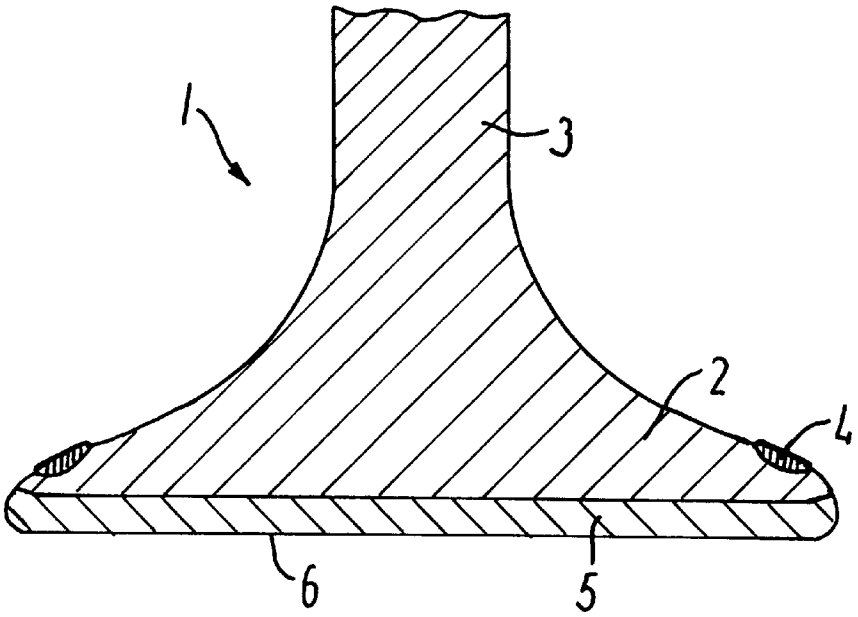

MOVABLE WALL MEMBER IN THE FORM OF AN EXHAUST VALVE SPINDLE OR A PISTON IN AN INTERNAL COMBUSTION ENGINE

The present invention relates to a movable wall member in the form of an exhaust valve spindle or a piston in an internal combustion engine, particularly a two-stroke cross-head engine, the side of the wall member facing a combustion chamber being provided with a hot-corrosion-resistant material made from a particulate starting material of a nickel and chromium containing alloy which by a HIP process has been unified to a coherent material substantially without melting the starting material.

A hot-corrosion-resistant material in the present context means a material which is resistant to corrosion in the environment existing in the combustion chamber of an internal combustion engine at an operating temperature ranging from 550° C. to 850° C.

From practical construction of large two-stroke diesel engines of the make MAN B&W Diesel, an exhaust valve spindle of the compound type is known in which the lower surface of the valve disc and the seat area of a spindle base are provided by a HIP process with a layer of hot-corrosion-resistant material of the alloy Nimonic 80A, which contains 18–21% chromium and approximately 75% nickel. In addition to its corrosion resistance, this alloy is of such a hardness, approximately 400 HV20, that it is suitable as valve seat material. Conventionally, valve seats have to have a high hardness to counteract the formation of dent marks in the sealing surfaces when residual particles from the combustion process are squeezed tight between the seat surfaces at the valve closure.

EP-A 0 521 821 describes the use of the alloy Inconel 671 as a hardfacing alloy in the valve seat area. This alloy contains 0–04–0.05% C, 47–49% Cr, 0.3–0.40% Ti and a balance of Ni. The valve seat area is located on the upper surface of the valve disc as a continuous annular facing. As mentioned above it is a condition for seat areas that the alloy has a high hardness. The EP publication mentions that Inconel 671 is supposed to have a poorer corrosion resistance than the alloy Inconel 625, which is also proposed as a hardfacing material.

The Applicant's international patent application published as WO96/18747 describes an exhaust valve spindle with a welded-on hardfacing alloy analyzed at 40–51% Cr, from 0 to 0.1% C, less than 1.0% Si, from 0 to 5.0% Mn, less than 1.0% Mo, from 0.05 to 0.5% B, from 0 to 1.0% Al, from 0 to 1.5% Ti, from 0 to 0.2% Zr, from 0.5 to 3.0% Nb, an aggregate content of Co and Fe of 5.0% at the most, at the most 0.2% O, at the most 0.3% N and a balance of Ni. After the welding a high hardness of, for example, 550 HV20, is imparted to this valve seat material by means of a heat treatment at a temperature exceeding 550° C.

It is generally presumed that hot-corrosion-resistant alloys containing chromium and nickel age-harden at temperatures ranging from 550° C. to 850° C., viz. the alloy becomes harder and more brittle. In the case of cast members, to achieve excellent hot corrosion resistance, particularly in environments containing sulphur and vanadium from heavy fuel oil combustion products, it is known to use an alloy of the type 50% Cr and 50% Ni or an alloy of the type IN 657 consisting of 48–52% Cr, 1.4–1.7% Nb, at the most 0.1% C, at the most 0.16% Ti, at the most 0.2% C+N, at the most 0.5% Si, at the most 1.0% Fe, at the most 0.3% Mg and a balance of Ni. After casting, the alloy comprises a nickel-rich γ-phase and a chromium-rich α-phase where both phases, depending on the accurate analysis of the alloy, may constitute the primary dendrite structure. It is known that these alloys age-harden at operating temperatures exceeding 600° C. This is because the alloy, when it cools off, does not solidify in its equilibrium state. When the alloy is subsequently at the operating temperature, precipitation of the under-represented phase proportion occurs by transformation of the over-represented phase proportion, which causes embrittlement characterized in a ductility of less than 4% at room temperature. Owing to these relatively poor strength properties, the alloys have been used exclusively for low-load cast members.

The technical article "Review of operating experience with current valve materials" published by The Institute of Marine Engineers, London, in 1990, provides an overview of applicable facing alloys for exhaust valves for diesel engines, and describes the problems of hot corrosion in diesel engines in detail. The article is especially aimed at conditions existing at the seating surfaces of the exhaust valve spindle.

At the lower surface of the valve spindle and at the upper surface of the piston the hot-corrosion-resistant material is to limit corrosive attacks so that the valve spindle and/or the piston achieve(s) an advantageously long life. The upper piston surface and the lower valve disc surface have large areas and are therefore exposed to considerable heat stresses when the engine load is changed, for example when the engine is started or stopped. The heat impact is heaviest at the middle of the areas, partly because the combustion gases have the highest temperature near the middle of the combustion chamber, partly because the piston and the valve spindle are cooled near the edges of the areas. The valve disc is cooled near the seat areas on the upper surface, which is in contact with the water-cooled stationary valve seat while the valve is closed, and as for the piston heat is conducted away to the water-cooled cylinder liner through the piston rings in addition to the oil cooling of the inner piston surface. The colder peripheral material prevents thermal expansion of the hotter central material, causing considerable heat stresses.

It is well-known that the slowly varying, but large heat stresses caused by said thermal influences can cause star cracking initiated at the middle of the lower surface of the valve disc. The star cracks may become so deep that the hot-corrosion-resistant material is penetrated so that the subjacent material is exposed to the corrosive impact and is eroded, leading to failure of the exhaust valve.

The object of the present invention is to provide an exhaust valve spindle or a piston having an advantageously long life for the hot-corrosion-resistant material.

In view of this the wall member stated in the introduction of claim 1 is characterized according to the invention in that in terms of percent by weight and apart from the common impurities and inevitable residual amounts of deoxidizing components the corrosion-resistant material comprises from 38 to 75% Cr and optionally from 0 to 0.15% C, from 0 to 1.5% Si, from 0 to 1.0% Mn, from 0 to 0.2% B, from 0 to 5.0% Fe, from 0 to 1.0% Mg, from 0 to 2.5% Al, from 0 to 2.0% Ti, from 0 to 8.0% Co, from 0 to 3.0% Nb as well as optional components of Ta, Zr, Hf, W and Mo, and a balance of Ni, the aggregate contents of Al and Ti amounting at the most to 4.0%, and the aggregate contents of Fe and Co amounting at the most to 8.0%, and the aggregate contents of Ni and Co amounting at the least to 25%, and that the corrosion-resistant material has a hardness of less than 310 HV measured at approximately 20° C. after the material has been heated to a temperature within the range of 550–850° C. for more than 400 hours.

Quite surprisingly it has proved that the material of this composition produced by the HIP process does not harden at the operating temperatures to which the movable wall member is exposed in an internal combustion engine, and it is thus possible to maintain an advantageous low hardness of less than 310 HV20 and associated suitable ductility of the hot-corrosion-resistant material on the side of the movable wall member facing the combustion chamber. The low hardness limits or prevents crack formation in the material, and the life of the wall member is thus not limited by fatigue failures in the material. The invention provides the further advantage that the material retains very fine mechanical properties even after a long-term heat influence. Thus the material retains a high tensile strength combined with high ductility, which is quite unusual for nickel alloys with a high content of chromium. These properties also render it possible for the corrosion-resistant material to replace at least part of the usual load-bearing material of the wall member so that the wall member can be formed with a lower weight than in the known wall members, where the corrosion-resistant material is arranged as a facing on the outside of the material required for strength. This weight reduction is advantageous in internal combustion engines because less weight means less energy consumed for moving the wall member and lower loads on the engine components cooperating with the wall member. In addition the effect is a saving in material. At the same time the material with its high content of chromium is extremely resistant to hot corrosion so that an evenly distributed erosion of the material takes substantially longer than in wall members with facings of the prior-art chromium and nickel containing types of material.

To avoid considerable hardening of the hot-corrosion-resistant material when the valve or the spindle is put to use, it is essential that the particulate starting material is neither melted nor exposed to considerable mechanical deformation at the manufacture of the wall member. The HIP process unifies the particulate starting material by, i.a., diffusion-based breakdown of the boundaries between the particles, which retains the very dense dendritic structure of the particles with closely adjacent dendrite branches. In the prior-art nickel-based hardfacings with a content of chromium within the range of 40–52% the starting material is melted in connection with casting or welding, and subsequent heating to temperatures exceeding 550° C. releases the inherent tendency of these materials to age-harden or precipitation harden to a high hardness. So far, in metallurgical terms no satisfactory explanation can be given for the suppression of the hardening mechanism in the HIP-produced material in the wall member according to the invention, but it has surprisingly proved to be the case.

If the content of chromium of the material becomes less than 38%, the desired resistance to hot corrosion is not obtained. At the surface of the wall member, chromium reacts with oxygen to form a surface layer of $Cr_2O_3$ protecting the subjacent material from the influences from the corrosive residual combustion products. The Cr content may advantageously be higher than 44.5%. If the content of chromium exceeds 75%, the nickel content of the material becomes too low, and in addition at the high temperatures used for the HIP process undesired local transformations into pure $\alpha$-phase may occur, viz., a chromium-rich phase without dendritic structure. The $\alpha$-phase is brittle, and increasing proportions of this phase in the structure negatively affect the ductility of the material. Preferably the Cr content of the material is higher than 49% in order thus to increase corrosion resistance.

The material has to have aggregate contents of cobalt and nickel of at least 25% to have the desired ductility counteracting cracking. If the alloy does not contain Co, the Ni content thus has to be at least 25%. Apart from said lower limit for the chromium content, there is no structurally motivated upper limit to the content of nickel.

If the C content exceeds 0.15%, undesired carbide boundary layers may precipitate on the particle surfaces, and precipitation of hardness-increasing carbides, such as NbC, WC or TiC, may also occur. Depending on the amounts of the other components of the material, C may also form undesired chromium carbides. To achieve high safety against precipitation of carbide compounds the C content is preferably less than 0.02%, but since C is a common impurity in many metals it may be suitable for economic reasons to limit the C content to 0.08% at the most.

A silicon content of up to 1.5% can contribute to improved corrosion resistance, Si forming silicon oxides at the surface of the material, which are very stable in the environment existing in the combustion chamber of a diesel engine. If the Si content exceeds 1.5%, undesired amounts of hardness-increasing silicides may precipitate. Si may also have a solution-strengthening effect on the nickel-rich $\gamma$-phase in the basic structure of the material. For this reason it may be desirable to limit the Si content of the material to 0.95% at the most.

Like Si, aluminium can improve corrosion resistance by forming aluminium oxide on the surface of the wall member. Furthermore, Al, Si and/or Mn may be added at the manufacture of the particulate starting material, these three components having a deoxidizing effect. As Mn does not contribute to the desired material properties of the wall member, the residual amount of Mn in the material is desirably limited to 1.0% at the most.

Up to 0.5% Y and/or up to 4.0% Ta may be added to stabilize the oxide formations on the surface of the material in the same manner as at additions of Al and Si. Larger amounts of yttrium and tantalum do not provide any further improvement of the corrosion resistance.

Al may form a hardness-increasing intermetallic compound with nickel ($\gamma'$), and therefore the material may contain at the most 2.5% Al. If the alloy also contains Ti in larger amounts of at the most 2.0%, the aggregate contents of Al and Ti of the material may not exceed 4.0%, as Ti may also form part of the undesired $\gamma'$-precipitations. To benefit from the corrosion-protective effect of aluminium and at the same time obtain a suitable safety against precipitation of $\gamma'$, the material preferably contains less than 1.0% Al, the aggregate contents of Al and Ti at the same time amounting to 2.0% at the most. If the alloy contains Ti in an amount near the upper limit therefor, the Al content can advantageously be limited to 0.15% at the most. To further suppress the formation of $\gamma'$, the Al content is preferably less than 0.4%.

Ti is a frequently occurring component of alloys containing chromium and nickel, and therefore it may be difficult to completely avoid a certain Ti content in the material. Preferably the Ti content is less than 0.6% to counteract precipitations of hardness-increasing titanium carbides and borides. The interaction between Al and Ti renders it desirable to limit the Ti content to less than 0.09% so that Al can be added in amounts that can improve the resistance of the material to hot corrosion.

The Fe content of the material is desirably limited to 5% at the most, the corrosion resistance decreasing with a higher Fe content. It is also possible to use a starting material containing cobalt, which does not have a negative influence proper on the corrosion resistance. Cobalt can partly replace nickel in the material if desirable for economic reasons. In amounts of up to 8.0% Co has no noticeable solution-strengthening effect on the γ-phase. Also in the cases when a nickel substitute is not desired, additions of cobalt in amounts of up to 8.0% may be desirable because Co can alter the relative amounts of α-phases and γ-phases in a direction advantageous to the ductility of the material in that Co promotes formation of the γ-phase. This may be desirable in particular if the material contains much Cr, for example more than 60% Cr.

Boron can contribute to the particulate starting material of the mixed phase α+γ having a very dense dendritic structure with a short distance between the dendrite branches. If the B content exceeds 0.2%, the amount of boron-containing eutectic and boride precipitations may assume an extent producing an undesired hardness-increasing effect. In amounts of up to 0.15%, Zr may have the same favourable effect on the dendritic structure of the material as B and can therefore be used as an alternative or as a supplement to the addition of B. Preferably the B content is less than 0.09% to limit the amount of hardness-increasing precipitations.

The particulate starting material may contain residual amounts of magnesium, but this component apparently entails no advantages in the present use, and therefore the Mg content of the material is desirably limited to 1.0% at the most.

In a preferred embodiment the content in the material of the inevitable impurities N and O is limited to at the most 0.04% N and/or at the most 0.01% O. The content of O in the starting material may cause oxide coatings on the particles, and after the HIP process such coatings will be present as inclusions in the material, reducing its strength. The amount of N can advantageously be limited to said 0.04% to counteract the formation of hardness-increasing nitrides or carbonitrides.

Niobium can be added to the alloy used in the manufacture of the particulate starting material. For economic reasons the Nb content is preferably limited to 0.95% at the most, but if the alloy contains noticeable amounts of N and amounts of C near the upper limit of 0.15%, it may be desirable to add up to 2.0% Nb to neutralise the tendency of N and C to form undesired carbide and nitride boundary layers on the particle surfaces. In the corrosion-resistant material niobium in amounts of up to 3.0% has surprisingly proved to have a positive influence on the structural transformations occurring at long-term operation of the wall member in the relevant temperature range. Thus an Nb content of more than 0.1% and preferably from 0.9 to 1.95% contributes to the material retaining a high ductility after long-term operation.

W and Mo are undesired components in the material, and if they occur, the material preferably contains less than 1.4% W and less than 0.9% Mo and the aggregate contents of W and Mo are less than 2%. This is due to the fact that both W and Mo have a solution-strengthening effect on the basic structure, the α+γ phase, in the material, which increases the hardness. To avoid precipitation of intermetallic compounds based on W and Mo, the aggregate contents of W and Mo are preferably less than 1.0%.

Hf in amounts of 0.1–1.5% have a grain boundary modifying effect which has a positive effect on the ductility of the material at the operating temperature of the material in the range of 550–850° C.

It is well-known that a facing of pure chromium on the surface of an element provides an extremely good corrosion resistance, but also that such a facing is very brittle without noticeable ductility. With the present invention it is possible to mix particles of a chromium content of more than 75 percent by weight, such as pure chromium particles, into the starting material at the surface facing the combustion chamber. Thus the wall member may be provided with a surface layer having a further improved corrosion resistance. The consequent reduced ductility of the surface layer may lead to cracking in it. The cracks will expose the subjacent material which, as described above, has a high ductility, which prevents the cracks from developing into deeper cracks, and is hot corrosion resistant, limiting the corrosive erosion. The addition of the high-chromium-content particles thus enables the provision of a wall member having an optimum combination of corrosion resistance and ductility.

During the life of the wall member, the chromium content in the crystal grains near the surface will be reduced in step with the burning off of the chromium oxides at the surface of the member. The addition of the high-chromium-content particles counteracts this tendency as the high temperature level at the surface makes chromium from the high-chromium-content particles diffuse into the adjacent crystal grains of the composition indicated in claim 1. If high-chromium-content particles are included further inside the material, such particles do not lead to any significant reduction of the ductility of the material. This is due to the fact that the temperature level further inside the material is lower, which restricts the tendency of chromium to diffuse into the adjacent crystal grains. Thus a varied composition may be imparted to the particulate starting material with a falling content of high-chromium-content particles at an increasing distance from the surface of the wall member.

With a view to obtaining high ductility, the corrosion-resistant material preferably has a hardness of less than 300 HV after heating to the temperature mentioned in claim 1 for said time, and even more advantageously the hardness is less than 285 HV measured at approximately 20° C.

In one embodiment it is possible to have a thickness of the corrosion-resistant material larger than 8 mm in a direction at right angles to the surface of the wall member. This does entail a larger consumption of the relatively costly starting material, but at the same time the life of the wall member is prolonged approximately in proportion with the thickness of the material because the material has no tendency to cracking, but on the contrary is eroded relatively evenly. If the thickness of the hot-corrosion-resistant material is further increased to being, for example, larger than 15 mm, the further effect is obtained that the material becomes an actual structural part of the wall member instead of being merely a corrosion-protective facing.

Figure 2:
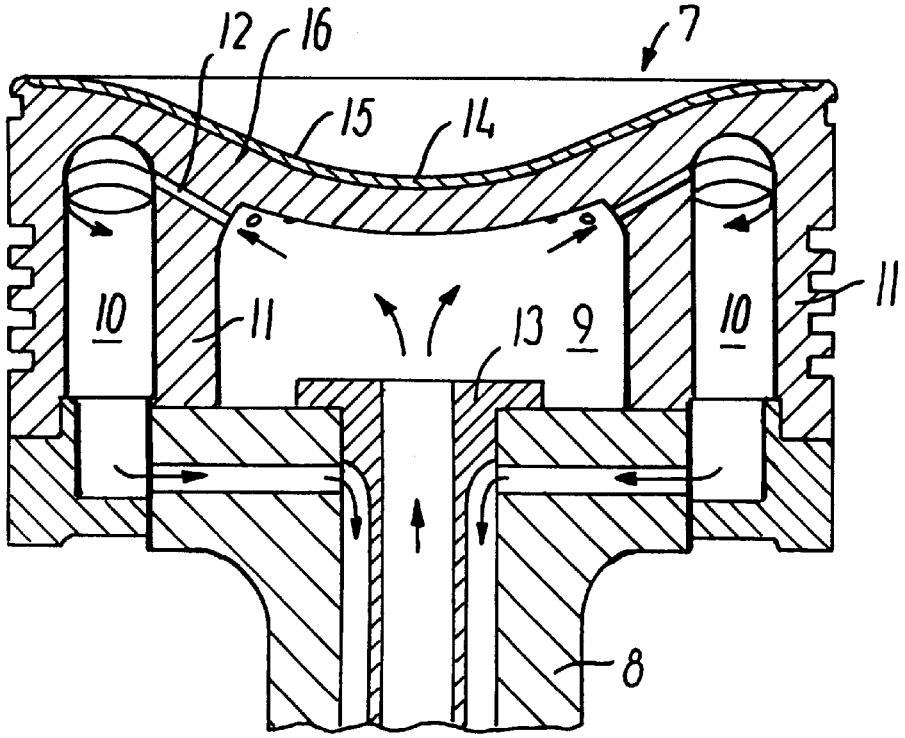

Examples of the invention will now be explained in further detail below with reference to the very schematic drawing, in which FIG. 1 is a central longitudinal sectional view of a valve disc with the bottom part of a valve shaft formed according to the invention, and FIG. 2 is a central longitudinal sectional view of a piston formed according to the invention.

FIG. 1 shows a wall member in the form of a valve spindle 1 for an exhaust valve in a two-stroke crosshead engine. The valve spindle comprises a valve disc 2 and a valve shaft 3, of which only the bottom part is shown. A valve seat 4 at the upper surface of the valve disc is manufactured in a hot-corrosion-resistant alloy with a high hardness counteracting the formation of dent marks on the sealing surface of the seat. The lower surface of the valve disc has a layer of hot-corrosion-resistant material 5 counteracting the burning off of material from the downward surface 6 of the disc. As described above, the material 5 is made in accordance with the invention and possesses the advantageous combination of high ductility and high resistance to hot corrosion.

FIG. 2 shows a wall member in the form of a piston 7 mounted on top of a piston rod 8, of which only the top part is shown. The piston has a central cavity 9 and many vertical bores 10 evenly distributed along the piston periphery in the piston skirt 11 encircling the cavity 9. Through smaller bores 12 the cavity 9 is connected with the vertical bores 10 so that cooling oil from a central tube 13 in the piston rod can flow into the cavity and further through the bores 12 into the vertical bores 10, from where the oil returns through the piston rod. The flow path of the cooling oil is indicated by arrows. The oil cools the lower surface of the piston top 16, but nevertheless temperature differences will occur at the upper surface of the piston top with resulting heat stresses in its material.

The piston may, of course, also be of other designs, for example a large number of spraying tubes may be inserted in a piston bottom for spraying cooling oil up against the lower surface of the piston top, or the central cavity may have a larger diameter so that the cooling of the piston top is mainly carried out by means of splash cooling.

At its upper surface the piston top has a layer of hot-corrosion-resistant material 14 counteracting burning off of material from the upward surface 15 of the piston. As described above, the material 14 is formed in accordance with the invention and possesses the advantageous combination of high ductility and high resistance to hot corrosion.

When the engine is running, the piston is reciprocated in a cylinder liner, not shown, and at suitable times of the engine cycle, the exhaust valve is opened and closed by the valve spindle being moved away from and back against a stationary valve seat part, also not shown, which has a valve seat with an annular downward sealing surface which, in the closed position of the valve, abuts the upward valve seat 4 of the spindle.

The movable wall members 1, 7 together with the cylinder liner and a cylinder cover, not shown, define the combustion chamber of the engine and are thus exposed to the hot and aggressive environment occurring at the combustion process.

If the engine is a two-stroke cross-head engine, the diameter of the piston may, for example, range from 250 to 1000 mm, and the diameter of the disc of the valve spindle may, for example, range from 100 to 600 mm. It appears from this that the surfaces of the movable wall members facing the combustion chamber have large areas, which gives rise to large heat stresses in the materials 5, 14.

The advantageous properties of the movable wall members 1 and 7 can also be exploited in smaller engines, for example four-stroke engines of the medium or high-speed type, but they are especially applicable in said large engines where the loads are heavy.

A description now follows of how the material 5, 14 is manufactured on the movable wall members 1, 7, respectively. A basic body of a suitable material, such as steel, austenitic steel or a Nimonic alloy indicated in the above British article is manufactured in the usual manner to the desired shape without the hot-corrosion-resistant material 5, 14. Then the material 5, 14 is applied to the basic body by a well-known HIP process (HIP is an abbreviation of Hot Isostatic Pressure). This process uses particulate starting material which may, for example, be manufactured by atomization of a liquid jet of a melted nickel and chromium containing alloy into a chamber with an inactive atmosphere, whereby the drop-shaped material is quenched and solidifies as particles with the very dense dendritic structure $\alpha+\gamma$. The particulate material may also be called a powder.

The particulate starting material is placed in a mould in an amount adjusted to the desired thickness of the material 5, 14. As mentioned, at the same time high-chromium-content particles may be mixed into the area near the bottom of the mould. Then the basic body is placed on top of the particulate material, the mould is closed and a vacuum is applied to extract undesired gases. Then the HIP process is started in which the particulate material is heated to a temperature ranging from 950 to 1200° C., and a high pressure of, for example, 900 to 1200 bar is applied. At these conditions the starting powder becomes plastic and is unified to a coherent, dense material substantially without melting. Then the wall member is removed and, if necessary, machined to the desired dimensions.

For the valve spindles 1 it is possible to use a valve disc 2 without shaft 3 as a basic body, the shaft then being mounted on the valve disc after conclusion of the HIP process. This mounting may, for example, be carried out by means of friction welding. The advantage of this is that the basic body is easier to handle in the HIP process when the shaft is post-mounted. Furthermore it is possible to manufacture the whole valve disc or, if desired, the whole valve spindle from particulate material by means of the HIP process, different particle compositions being used in different areas of the body and adapted to the desired material properties in the areas in question and based on economic considerations.

Examples will now be given below to illustrate the mechanical properties of the hot-corrosion-resistant material.

EXAMPLE 1

Based on particulate starting material analyzed at 46% Cr, 0.4% Ti, 0.05% C and a balance of Ni, a rod-shaped body with a diameter of 30 mm and a length of approximately 1000 mm was manufactured by means of the HIP process. After placing in the mould, the starting material was heated to a temperature of 1150° C. and pressurized to approximately 1000 bar, and after a dwell time of approximately 2.5 hours at these conditions the body was returned to room temperature and normal pressure. From the rod-shaped body, sample discs approximately 8 mm thick were cut. The average hardness of the discs was measured at 269 HV20 at room temperature. The discs were then heat treated at a temperature of 700° C. for 672 hours. After the heat treatment the average hardness of the discs at room temperature was measured at 285 HV20. It could thus be ascertained that the heat treatment only gave rise to a very limited increase in hardness.

EXAMPLE 2

Based on particulate starting material analyzed at 49.14% Cr, 1.25% Nb, 0.005% C and a balance of Ni a rod-shaped body was manufactured in the same manner as in Example 1, and sample discs were cut, the average hardness of which was measured at 292 HV20. The discs were then heat treated at a temperature of 700° C. for 672 hours, whereupon their average hardness was measured at 260 HV20. It could thus be ascertained that the heat treatment gave rise to a reduction in hardness.

EXAMPLE 3

In the same manner as in Example 1, three rod-shaped bodies where then manufactured, the first one of which was analyzed at 46% Cr, 0.4% Ti, 0.05% C and a balance of Ni, the second one of which was analyzed at 49.14% Cr, 1.25% Nb, 0.005% C and a balance of Ni, and the third one of which was analyzed at 54.78% Cr, 1.26% Nb, 0.005% C, 0.1% Fe and a balance of Ni. From each of the three bodies, pieces 120 mm long were cut and machined in the usual manner into tensile test pieces. The test diameter of the test pieces with 46% Cr was 3 mm, while the test diameter of the test pieces of the two other alloys was 5 mm. The average hardness of the test pieces was measured, whereupon a batch of test pieces was heat treated for 48 hours at 700° C., a second batch of test pieces was heat treated for 336 hours at 700° C., and a third batch of test pieces was heat treated for 672 hours at 700° C. Out of the two last-mentioned alloys a fourth batch of test pieces was furthermore manufactured with a test diameter of 6 mm. The fourth batch of test pieces was heat treated for 4392 hours at 700° C. After the heat treatments the average hardness at room temperature of the test pieces was measured, and tensile tests and impact tests were carried out at room temperature to test the mechanical properties of the materials. The hardness measurement was carried out according to the Vickers method (HV20), and the impact strength was measured according to Charpy's U-notch test in which the minimum load-bearing area of the test pieces was fixed at 0.5 $cm^2$. The test results are reproduced in the below Tables 1 and 2. It should be noted that the measuring results marked by an asterisk indicate test pieces which fractured prematurely owing to a machining error.

The test results show that the HIP-manufactured hot-corrosion-resistant material does not have its ductility reduced by a long-term heat load at a temperature level representative of operating temperatures for movable wall members in the combustion chamber of a large two-stroke engine.

It also appears that the other mechanical properties of the material are excellent. The tensile strength of the material before heat treatment is substantially higher than is usual for nickel alloys with a high content of chromium. The heat treatment is seen to give a limited drop in tensile strength down to a level which is still advantageously high. The heat-treated test pieces generally exhibit an elongation at rupture of more than 20%. At the heat treatment, also an increase in elongation at rupture and in area reduction is seen, which means that the material gets a higher ductility. It also appears that the niobium containing materials heat treated for just below 4400 hours achieve an elongation at rupture of approximately 30%, the area reduction being at approximately 50% after long-term heat influence. At the heat treatment from 672 to 4392 hours, the elongation at rupture is seen to have increased by up to 50%. These results show that the corrosion-resistant materials according to the invention are valid construction materials with extremely fine strength properties, also after a long-term heat influence.

The materials also appear to have an extremely high impact strength. Compared to the impact strength of the HIP-manufactured material, the impact strength is increased considerably by the heat treatment which imitates the operating conditions of the materials. Thus, apart from immaterial reductions of yield stresses and tensile stresses, the corrosion-resistant materials achieve better strength properties in operation at temperatures ranging between 550° C. and 850° C.

The extremely fine mechanical properties of the material render it suitable as a construction material proper, which at the same time has the excellent corrosion-resistant properties known per se.

As further examples of corrosion-resistant materials according to the invention may be mentioned the material with the following composition: 60% Cr, at the most 0.02% C, at the most 0.2% Si, at the most 0.5% Mn, at the most 0.5% Mo, at the most 0.2% Cu, at the most 0.005% B, at the most 0.002% Al, at the most 0.02% Ti, at the most 0.02% Zr, 1.25% Nb, at the most 0.5% Co, at the most 0.5% Fe, at the most 0.05% N, at the most 0.02% O, and a balance of Ni, and the material with the following composition: 45% Cr, at the most 0.02% C, 1.5% Si, at the most 0.5% Mn, at the most 0.5% Mo, at the most 0.2% Cu, at the most 0.005% B, at the most 0.002% Al, at the most 0.02% Ti, at the most 0.02% Zr, 1.25% Nb, at the most 0.5% Co, at the most 0.5% Fe, at the most 0.05% N, at the most 0.02% O and a balance of Ni.

In the above description, all percentages of alloy components are expressed in terms of percent by weight.

TABLE 1

| Heat Treatment Temperature/Time | Tensile strength $R_m$ N/mm$^2$ | 0.2 Proof Stress $R_p$ N/mm$^2$ | Elongation $A_{tot}$ % | Reduction of Area Z % | Vickers hardness HV20 kp/mm$^2$ | U-notch Impact Strength J/cm$^2$ |
|---|---|---|---|---|---|---|
| 46% Cr, 0.4% Ti, 0.05% C and a balance of Ni | | | | | | |
| 20° C. | 988 | 692 | 17.8 | 32.1 | 272 | 34 |
| 700° C./48 hours | 944 | 597 | 25 | 43.4 | 270 | 38 |
| 700° C./336 hours | 978 | 664 | 18 | 40.8 | 280 | 34 |
| " | 976 | 646 | 18 | 46.2 | " | |
| 700° C./672 hours | 959 | 644 | 17 | 43.3 | 280 | |
| " | 961 | 635 | 15 | 42.4 | " | |
| 49.14% Cr, 1.25% Nb, 0.005% C and a balance of Ni | | | | | | |
| 20° C. | 1015 | 636 | 21 | 42.2 | 294 | 42 |
| " | 1027 | 642 | 22 | 39.2 | " | |
| 700° C./48 hours | 916 | 605 | 23 | 50.0 | 268 | 50 |
| " | 923 | 612 | 22 | 51.0 | " | |
| 700° C./336 hours | 904 | 598 | 22 | 52.8 | 270 | 60 |
| " | 898 | 586 | 22 | 55.5 | " | |
| 700° C./672 hours | 910 | 573 | 22 | 52.8 | 264 | |
| " | 848* | 586 | 13* | 44.1* | " | |
| 700° C./4392 hours | 879 | 611 | 30 | 48.6 | 263 | 58 |
| " | 883 | 565 | 31.7 | 46.2 | " | 50 |
| " | 883 | 569 | 26.7 | 51 | " | 50 |
| " | 891 | 565 | 31.7 | 51 | " | 50 |

TABLE 2

| Heat Treatment Temperature/Time | Tensile strength $R_m$ N/mm$^2$ | 0.2 Proof Stress $R_p$ N/mm$^2$ | Elongation $A_{tot}$ % | Reduction of Area Z % | Vickers hardness HV20 kp/mm$^2$ | U-notch Impact Strength J/cm$^2$ |
|---|---|---|---|---|---|---|
| 54.78% Cr, 1.26% Nb, 0.005% C, 0.1% Fe and a balance of Ni | | | | | | |
| 20° C. | 1113 | 740 | 13 | 15.4 | 331 | 18 |
| " | 1100 | 734 | 11 | 11.6 | " | |
| 700° C./48 hours | 954 | 652 | 23 | 34.7 | 276 | 46 |
| " | 960 | 667 | 22 | 44.1 | " | |
| 700° C./336 hours | 910 | 617 | 22 | 44.1 | 271 | 36 |
| " | 910 | 611 | 21 | 44.1 | " | |
| 700° C./672 hours | 923 | 605 | 18 | 44.1 | 276 | |
| " | 929 | 605 | 20 | 45.6 | " | |
| 700° C./4392 hours | >777* | 560 | * | * | 265 | 30 |
| " | 879 | 556 | 30 | 41.2 | " | 24 |
| " | 883 | 556 | 28.3 | 43.7 | " | 24 |
| " | 874 | 560 | 28.3 | 48.6 | " | 30 |

What is claimed is:

1. A movable wall member in an internal combustion engine cylinder having a combustion chamber, wherein the wall member has a side, which faces the combustion chamber and is provided with a hot-corrosion-resistant material, which corrosion-resistant material in terms of percent by weight and apart from common impurities and inevitable residual amounts of deoxidizing components comprises from 38 to 75% Cr and a number of the following components from 0 to 0.15% C, from 0 to 1.5% Si, from 0 to 1.0% Mn, from 0 to 0.2% B, from 0 to 5.0% Fe, from 0 to 1.0% Mg, from 0 to 2.5% Al, from 0 to 2.0% Ti, from 0 to 8.0% Co, from 0 to 3.0% Nb, and a balance of Ni, aggregate contents of Al and Ti amounting at the most to 4.0%, and aggregate contents of Fe and Co amounting at the most to 8.0%, and aggregate contents of Ni and Co amounting at the least to 25%, said corrosion-resistant material being made from a particulate starting material which by a HIP process has been unified to a coherent material substantially without melting the starting material, and said corrosion-resistant material having a hardness of less than 310 HV measured at approximately 20° C. after the material has been heated to a temperature within the range of 550–850° C. for more than 400 hours.

2. A movable wall member as claimed in claim 1, wherein the member is selected from the group of an exhaust valve or a piston.

3. A movable wall member as claimed in claim 2, wherein said engine is a two-stroke crosshead engine.

4. A movable wall member as claimed in claim 3, wherein the content of C of said material is less than 0.08%.

5. A movable wall member as claimed in claim 4, wherein the content of C of said material is less than 0.02%.

6. A movable wall member as claimed in claim 5, wherein the content of Al of the material is less than 1.0% and aggregate contents of Al and Ti amount at the most to 2.0%.

7. A movable wall member as claimed in claim 6, wherein the content of Al is less than 0.4%, and the content of Ti is less than 0.6%.

8. A movable wall member as claimed in claim 1, wherein the content of Cr of the material is higher than 44.5%.

9. A movable wall member as claimed in claim 8, wherein the content of Cr of the material is higher than 49%.

10. A movable wall member as claimed in claim 1, wherein the content of N of the material is at the most 0.04%, and the content of O is at the most 0.01%.

11. A movable wall member as claimed in claims 1, wherein the material further contains up to 0.5% Y and up to 4.0% Ta.

12. A movable wall member as claimed in claim 1, wherein the content of Nb of the material is in the range of from 0.1% to 1.95%.

13. A movable wall member as claimed in claim 12, wherein the content of Nb of the material is at least 0.9%.

14. A movable wall member as claimed in claim 1, wherein the material further contains up to 0.15% Zr, and its content of B is less than 0.09%.

15. A movable wall member as claimed in claim 1, wherein the material contains from 0.1 to 1.5% Hf.

16. A movable wall member as claimed in claim 1, wherein the material further contains less than 1.4% W and less than 0.9% Mo, and aggregate contents of W and Mo being less than 2%.

17. A movable wall member as claimed in claim 16, wherein the aggregate contents of W and Mo are less than 1.0%.

18. A movable wall member as claimed in claim 1, wherein particles with a chromium content of more than 75% by weight are mixed into the starting material at least at the side facing the combustion chamber.

19. A movable wall member as claimed in claim 1, wherein the corrosion-resistant material, following the heating to said temperature for said time, has a hardness of less than 300 HV.

20. A movable wall member as claimed in claim 19, wherein the corrosion-resistant material has a hardness of less than 285 HV measured at approximately 20° C.

21. A movable wall member as claimed in claim 1, wherein the corrosion-resistant material has a thickness in a direction at right angles to said side of the wall member, said thickness being larger than 8 mm.

22. A movable wall member as claimed in claim 21, wherein said thickness is larger than 15 mm.

23. A member having having a side, which faces a combustion chamber and is provided with a hot-corrosion-resistant material, which corrosion-resistant material in terms of percent by weight and apart from common impurities and inevitable residual amounts of deoxidizing components comprises from 38 to 75% Cr and a number of the following components from 0 to 0.15% C, from 0 to 1.5% Si, from 0 to 1.0% Mn, from 0 to 0.2% B, from 0 to 5.0% Fe, from 0 to 1.0% Mg, from 0 to 2.5% Al, from 0 to 2.0% Ti, from 0 to 8.0% Co, from 0 to 3.0% Nb, and a balance of Ni, aggregate contents of Al and Ti amounting at the most to 4.0%, and aggregate contents of Fe and Co amounting at the most to 8.0%, and aggregate contents of Ni and Co amounting at the least to 25%, said corrosion-resistant material being made from a particulate starting material which by a HIP process has been unified to a coherent material substantially without melting the starting material, and said corrosion-resistant material having a hardness of less than 310 HV measured at approximately 20° C. after the material has been heated to a temperature within the range of 550–850° C. for more than 400 hours.

24. A hot-corrosion-resistant material, which in terms of percent by weight and apart from common impurities and inevitable residual amounts of deoxidizing components comprises from 38 to 75% Cr and a number of the following components from 0 to 0.15% C, from 0 to 1.5% Si, from 0 to 1.0% Mn, from 0 to 0.2% B, from 0 to 5.0% Fe, from 0 to 1.0% Mg, from 0 to 2.5% Al, from 0 to 2.0% Ti, from 0 to 8.0% Co, from 0 to 3.0% Nb and a balance of Ni, aggregate contents of Al and Ti amounting at the most to 4.0%, and aggregate contents of Fe and Co amounting at the most to 8.0%, and aggregate contents of Ni and Co amounting at the least to 25%, said corrosion-resistant material being made from a particulate starting material which by a HIP process has been unified to a coherent material substantially without melting the starting material, and said corrosion-resistant material having a hardness of less than 310 HV measured at approximately 20° C. after the material has been heated to a temperature within the range of 550–850° C. for more than 400 hours.

25. A hot-corrosion-resistant material according to claim 24, wherein the content of C of said material is less than 0.08%.

26. A hot-corrosion-resistant material according to claim 24, wherein the content of Al of the material is less than 1.0% and aggregate contents of Al and Ti amount at the most to 2.0%.

27. A hot-corrosion-resistant material according to claim 24, wherein the content of Cr of the material is higher than 44.5%.

28. A hot-corrosion-resistant material according to claim 24, wherein the material further contains up to 0.5% Y and up to 4.0% Ta.

29. A hot-corrosion-resistant material according to claim 24, wherein the content of Nb of the material is in the range of from 0.1% to 1.95%.

30. A hot-corrosion-resistant material according to claim 24, wherein the material further contains up to 0.15% Zr, and its content of B is less than 0.09%.

31. A hot-corrosion-resistant material according to claim 24, wherein the material contains from 0.1 to 1.5% Hf.

32. A hot-corrosion-resistant material according to claim 24, wherein the material further contains less than 1.4% W and less than 0.9% Mo, and aggregate contents of W and Mo being less than 2%.

33. A hot-corrosion-resistant material according to claim 24, wherein the corrosion-resistant material, following the heating to said temperature for said time, has a hardness of less than 300 HV.

34. A hot-corrosion-resistant material according to claim 33, wherein the corrosion-resistant material has a hardness of less than 285 HV measured at approximately 20° C.

* * * * *